United States Patent [19]

Seely

[11] 4,216,373

[45] Aug. 5, 1980

[54] METHOD AND APPARATUS FOR COPY-FITTING

[76] Inventor: Charles R. Seely, 6870 Dorinda Dr., Riverside, Calif. 92503

[21] Appl. No.: 848,904

[22] Filed: Nov. 7, 1977

[51] Int. Cl.[2] ..... G06C 3/00

[52] U.S. Cl. ..... 235/88 R

[58] Field of Search ..... 235/88 R, 88 M, 88 F, 235/88 G, 88 N, 88 RC

[56] References Cited

U.S. PATENT DOCUMENTS

| | | | |
|---|---|---|---|
| 1,076,929 | 10/1913 | Williamson | 235/88 R |
| 2,934,264 | 4/1960 | Miller | 235/88 R |
| 2,954,162 | 9/1960 | Parigini | 235/88 R |
| 3,610,520 | 10/1971 | Connell | 235/88 R |
| 3,946,207 | 3/1976 | Williams | 235/88 M |

*Primary Examiner*—L. T. Hix
*Assistant Examiner*—Benjamin R. Fuller
*Attorney, Agent, or Firm*—Herbert E. Kidder

[57] ABSTRACT

Method and apparatus for copy-fitting, using a new parameter called Font ID in a circular calculator having a plurality of relatively rotatable disks, some of which have cursors affixed thereto, and one or more freely rotatable cursors. Scales on the several disks include Font ID numbers, type size, in points; line length, in picas; number of characters per line; number of characters per page; page depth in picas and number of lines; and line spacing in points. By manipulating the calculator, it is possible to estimate from a typewritten manuscript the number of characters per line; the correct Font and line length required for a given number of characters of a given point size type; the correct Font and point size required to fit a given number of characters into a line of given length in picas; the number of characters contained in a given number of pages of specified type size, font, line length and page depth; and the number of pages of printed copy from a given number of characters of specified type size, Font, line length, and page depth. The operation of the calculator is based on the Font ID, which is a function of the width, in points, of the 26 characters in the alphabet; the most condensed style having the lowest Font ID number, and the most extended style having the highest Font ID number. In one form of the invention, the largest, or outer disk of the calculator is eliminated, and its Font ID and type size in points scales are printed directly on a font display chart, to which the other calculator disks are rotatably attached. The font display chart lists all fonts of different type styles carried by a particular print shop, the said fonts being listed in descending numerical values of Font ID from top to bottom, with guide paths leading from the listings to the respective Font ID values on the calculator scale.

2 Claims, 12 Drawing Figures

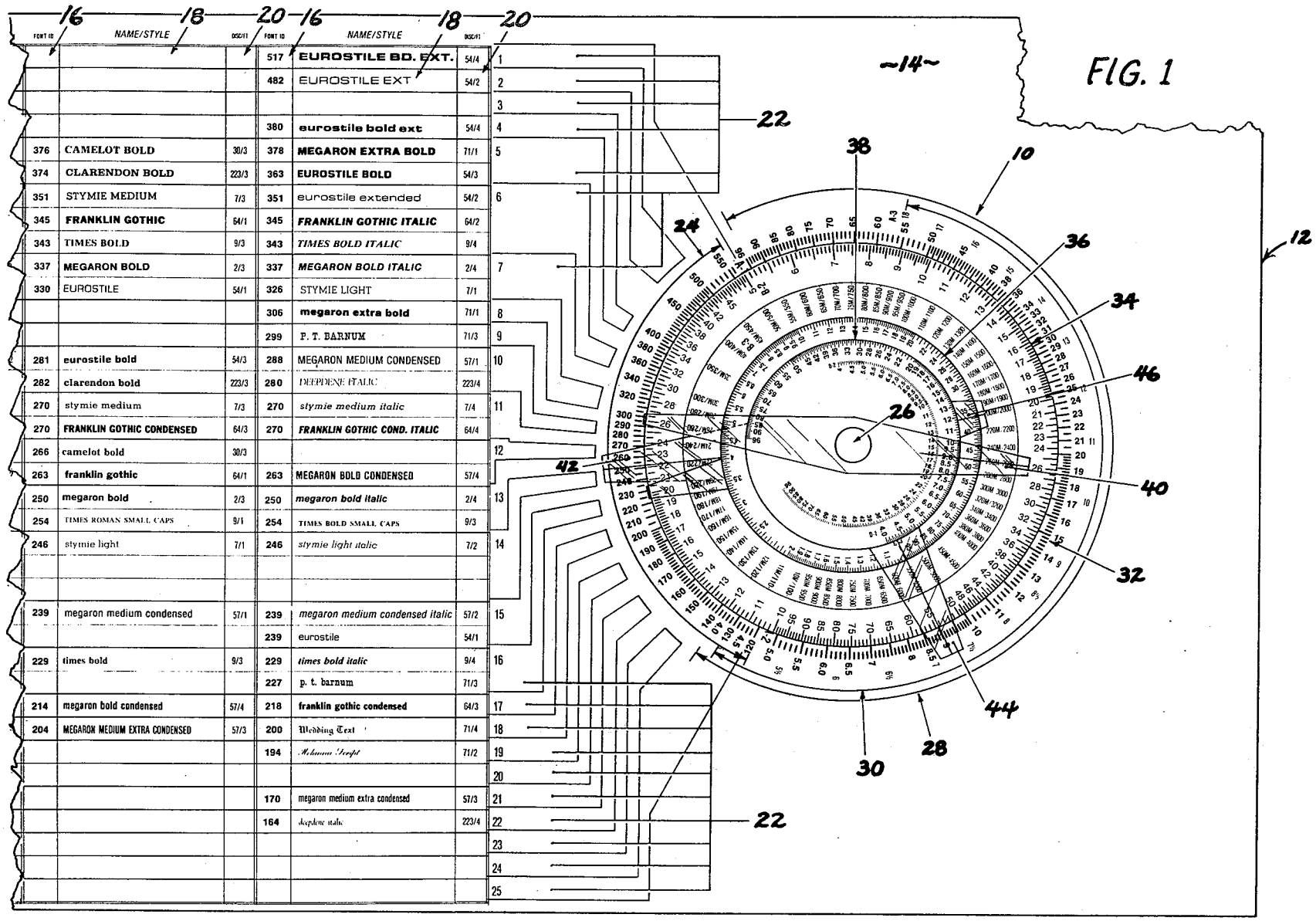
FIG. 1
10
12
14
16
18
20
22
24
26
28
30
32
34
36
38
40
44
46
NAME/STYLE
FONT ID
DESIGN
EUROSTILE BD. EXT.
EUROSTILE EXT
eurostile bold ext
MEGARON EXTRA BOLD
EUROSTILE BOLD
eurostile extended
FRANKLIN GOTHIC ITALIC
TIMES BOLD ITALIC
MEGARON BOLD ITALIC
STYMIE LIGHT
megaron extra bold
P. T. BARNUM
MEGARON MEDIUM CONDENSED
DEPPENE ITALIC
stymie medium italic
FRANKLIN GOTHIC COND. ITALIC
MEGARON BOLD CONDENSED
megaron bold italic
TIMES BOLD SMALL CAPS
stymie light italic
megaron medium condensed italic
eurostile
times bold italic
p. t. barnum
franklin gothic condensed
Blobbing Text
Modern Script
megaron medium extra condensed
Stephen italic
CAMELOT BOLD
CLARENDON BOLD
STYMIE MEDIUM
FRANKLIN GOTHIC
TIMES BOLD
MEGARON BOLD
EUROSTILE
eurostile bold
clarendon bold
stymie medium
FRANKLIN GOTHIC CONDENSED
camelot bold
franklin gothic
megaron bold
TIMES ROMAN SMALL CAPS
stymie light
megaron medium condensed
times bold
megaron bold condensed
MEGARON MEDIUM EXTRA CONDENSED 26
34
36'
38
42
42'
44'
46
48
50
52
56
58
60
62
C-1
C-2

METHOD AND APPARATUS FOR COPY-FITTING

BACKGROUND OF THE INVENTION

The present invention pertains to the art of typography, and more particularly to a method and apparatus for copy-fitting. Copy-fitting is the procedure used to measure the amount of space that a given amount of typewritten copy will occupy when set in type. It serves to determine, in advance, the correct type face, size and line width needed to fit copy to layout or layout to copy.

Gutenberg was credited with the invention of moveable type, ca. 1450 A.D. From that meager beginning of a single font of a single size, hundreds of additional type fonts have been introduced that range from extra condensed to extended, and from 4 points as the smallest to 240 points and larger. That's a long road from the meager beginning of a single type font of 30-point type which Gutenberg had.

In the early days, when a very few fonts of type were available, copy-fitting was no great problem. The procedure was to measure the length of the 26 letters in the alphabet, dividing the 26 by the measure to arrive at characters per pica. Using the characters per pica figure times the line length, one could arrive at the number of characters per line. But as the number of fonts increased, and with the fairly recent introduction of Photo-Typesetters with its range of from 4 points size to 96 points or even larger, the problem has become further compounded. With all the innovations of modern technology such as computer typesetting, photo-typesetters, etc., the only procedure available for copy-fitting calls for using the characters per pica of a given point size of a certain font to begin calculations. That printing could progress so far on the one hand and remain so stagnant on the other after approximately 527 years somewhat staggers the imagination.

The antiquated procedures available today require that the alphabet length be known for the point size of the particular font from which the copy-fitter wishes to set. With the wide range of sizes from 4 to 96 point type, and with the hundreds of fonts available, this entails maintaining thousands of alphabet lengths for effective copy-fitting.

Heretofore, it has been necessary to know the length of the alphabet from a particular font, in picas, of the point size being used, in order to determine the total number of characters required to fill a line of a certain length. The calculation would be as follows: consult listing for desired font to determine alphabet length of desired point size and solve the equations:

$$\frac{\text{number of characters in alphabet}}{\text{length of alphabet}} = \text{characters per pica}$$

and characters per pica × line length = characters per line

The above calculations required several known factors to arrive at the solution of one unknown. If the result was unsatisfactory, the listing had to be reviewed and a new calculation made. Add to this the fact that information was seldom provided for capitals or small capitals, and it becomes evident that the process of copy-fitting has always been a tedious and time-consuming operation.

SUMMARY OF THE INVENTION

The primary object of the present invention is to provide a new and unique method and apparatus for copy-fitting that eliminates all the tedious mathematical computation that has heretofore been necessary, and enables the copy-fitter to perform the copy-fitting procedure quickly and easily, and that also enables the copy-fitter to scan various alternative possibilities, using different fonts and type sizes.

The present invention is based on the use of a new parameter called Font ID's, which is utilized in a circular computer together with line lengths in picas, type sizes, page depth, leading, number of pages, and number of characters, to give a direct read-out of the desired information. Font ID's are related to type style, with the most condensed font having the lowest ID number, and the most extended the highest. Since a complete font of type consists of a lower case font, a capital font, and in some a small capital font, each complete font has at least two Font ID's unless, as is the case with Typewriter, the lower case font is as long as the capital font. Since more than one font can have the same rank, or position, the Font ID cannot be used as sole identification. The Font ID identifies the average set (width) of the 26 characters of the alphabet for a particular font. The name of the font, combined with the Font ID, is the absolute identification. The name identifies the style, and the Font ID places it on a scale between 1 and 1000, facilitating mathematical computation of the font in a manner never before possible.

The Font ID is determined by means of a circular calculator having a logarithmic scale graduated from 120 to 550, which represents the Font ID values. The graduations can be extended in either direction, if desired, although the range of 120 to 550 is adequate for the majority of type styles in use at this time.

In the preferred form of the invention, the circular calculator is integrally associated with a display chart listing all of the type fonts in inventory, together with their respective Font ID's; the said Font ID's being listed in descending numerical order from top to bottom, with guide paths on the chart leading from each type font example to the corresponding area of the Font ID scale. With this additional feature, the copy-fitter is able to select the most appropriate font of the desired type size from his inventory, or to consider various alternatives that are possible with the type fonts at hand. Using this embodiment of the invention, copy-fitters will work more efficiently and effectively at their jobs. Everything they need will be in front of them. Authors will know how many words to write to fill a certain area when set from a selected font and point size, or the number of pages their written words will require. Estimators will be more on target when bidding on new jobs, and many others will benefit from knowing exactly how many pages of printed text will be obtained from a manuscript, using various fonts, type size, line length, page depth and line spacing (leading). Heretofore, this information could only be obtained by arduous computing and re-computing, whereas with the invention, the same information is obtained by merely shifting one or another of the circular disks or movable cursors from one position to another.

Another embodiment of the invention uses the circular computer alone, without the display chart. With this form of the invention, all of the computations can be performed as in the embodiment described above, except that the type styles (fonts) in inventory are not directly before the copy-fitter, and therefore the fonts must be selected from another source.

Still another form of the invention uses a circular computer having slightly less capability than the two embodiments described above, in that it is primarily useful in copy-fitting individual lines, whereas the first two embodiments mentioned above are capable of copy-fitting hundreds of pages, and up to one million characters, showing the page requirements for line spacing increases of ½ point increments.

The foregoing and other objects and advantages of the invention will become apparent to those skilled in the art from the following detailed description of the preferred embodiments thereof, with reference to the accompanying drawings.

BRIEF DESCRIPTION OF THE DRAWINGS

FIG. 1 is a view of one embodiment of the invention, showing the preferred circular computer integrally associated with a font display chart (shown only fragmentarily) listing type fonts that any one particular print shop might have in inventory;

FIG. 6 shows the next smaller disk of the computer in FIGS. 1 and 3;

DESCRIPTION OF THE PREFERRED EMBODIMENTS

Figure 3:
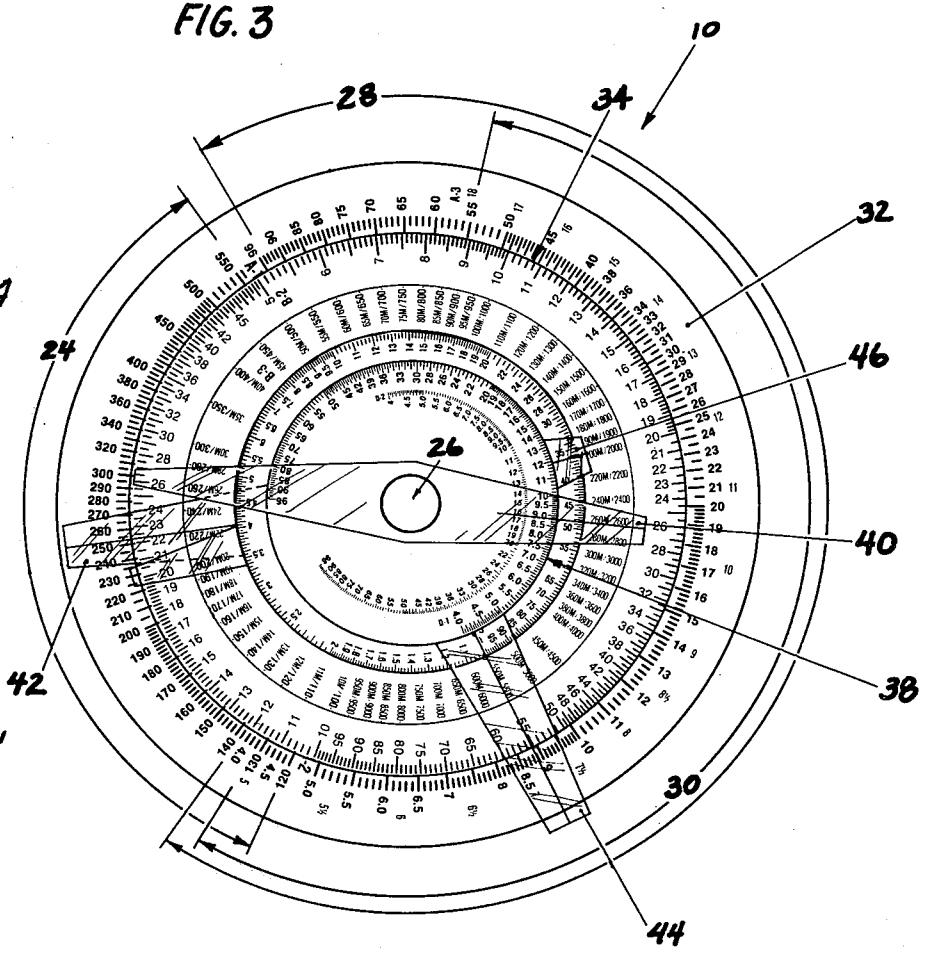
FIG. 3 shows another embodiment of the invention, comprising the circular computer of FIG. 1, by itself, and without the display chart.

The embodiments shown in FIGS. 1 and 3 both use the same circular calculator, which is designated in its entirety by the reference numeral 10; with the sole exception that the indicia printed on the outer disk of the calculator in FIG. 3 is printed directly on the font display chart of FIG. 1. Thus, the circular calculator of FIG. 1 has one disk less than the calculator of FIG. 3, but the missing disk is represented by the circular rows of indicia printed on the display chart. For all practical purposes, the outer rows of indicia on FIG. 1 may therefore be considered the outer disk of the computer, and will be referred to as such hereinafter.

The circular calculator 10 of FIG. 1 is integrally associated with a font display chart 12, consisting of a stiff, cardboard sheet 14 having a plurality of vertical columns, each comprising a first column 16 headed "Font ID", a second column 18 headed "name/Style", and a third column 20 headed "Disc/Ft"(for Disc-/Font). Each column contains a plurality of lines, in which are listed examples of different type styles, the type style being listed by name in column 18, by Font ID in column 16, and by disc/font number in column 20. The disc/font number is a numerical designation for locating the phototype disc and the font on that disc carrying that particular style of type. Each of the type style names is printed with the corresponding type, and as a general rule, the only type listed in the columns would be those that are carried in the inventory of the print shop, although other type styles might also be listed for reference purposes.

The type styles in the vertical columns are listed with their Font ID's in descending numerical order from the top down, with the highest Font ID number at the top, and the lowest at the bottom. The Font ID is a parameter that is a function of the width, in points, of the 26 characters in the alphabet for that particular font. As each font usually contains capitals, lower case, and small capitals, each font might have 3 Font ID's. However, the type style shown on each line of column 18 is only one of the three, i.e., it is either caps or lower case or small caps, and therefore only the one respective Font ID is shown. The other two would be listed on other lines. The derivation of the numerical values for the Font ID's will be described presently.

As shown in FIG. 1, there are guide paths 22 leading from the lines of type styles to the corresponding sections of a scale 24 of Font ID numerical values, which are arranged in a circular arc about the center 26 of the circular calculator 10. These Font ID numbers range from 120, at the bottom, to 550, at the top, and the graduations are spaced apart logarithmically. The smallest Font ID number (120) represents the most condensed type font in general use, whereas the largest Font ID (550) represents the most extended type font. These Font ID numbers are not absolute, in the sense that they can only range from 120 to 550. Instead, depending upon which type size, in points, is used as a basis, the numbers could be somewhat smaller or larger, but in each case, once a series of Font ID numbers has been derived, the same Font ID numbers would thereafter be used for all fonts and in all computations. For convenience, I have used 18 point type as the basis for determining the Font ID numbers, and the following derivation uses the 18 point type size.

The derivation of Font ID numbers is based on the proportionate ratio:

5616:Font ID::Point size of Type:Reciprocal of characters per pica

The number "5616" is a constant, which is obtained by multiplying $26 \times 12 \times 18$. The number "26" represents the number of characters in the alphabet; "12" represents the number of points in a pica; and "18" represents the point size of the type used as a basis. Thus, to find the Font ID of 18 point size type of a style having 1 character per pica, the proportionate ratio would read:

5616:Font ID::18:(1/1 )

From this it is seen that the Font ID of this particular type would be 312. If the type size were 10 points and there were 2.2 characters per pica, the ratio would read:

5616:Font ID::10:1/2.2

From this ratio, the Font ID is found to be 255. Other Font ID numbers can readily be determined by inserting the type size, in points, at the indicated place, and the reciprocal of the characters per pica.

Once the Font ID numbers have been derived and placed on the scale 24 of the circular calculator 10, it is a simple matter to determine the Font ID of any type font by merely manipulating the calculator, as will be explained later.

The remainder of the circle formed by the scale 24 of Font ID numbers, plus a slight amount of overlap at the low end, is taken up with a second scale 28 of type size, in points, ranging from 4 to 96 points. A third scale 30, just outside of scale 28, shows type sizes from 5 to 18 points, which is used only for determining the effect a type size change would have on the number of pages if all other factors remained the same. For most computations, the type size scale 28 is used.

Figure 5:
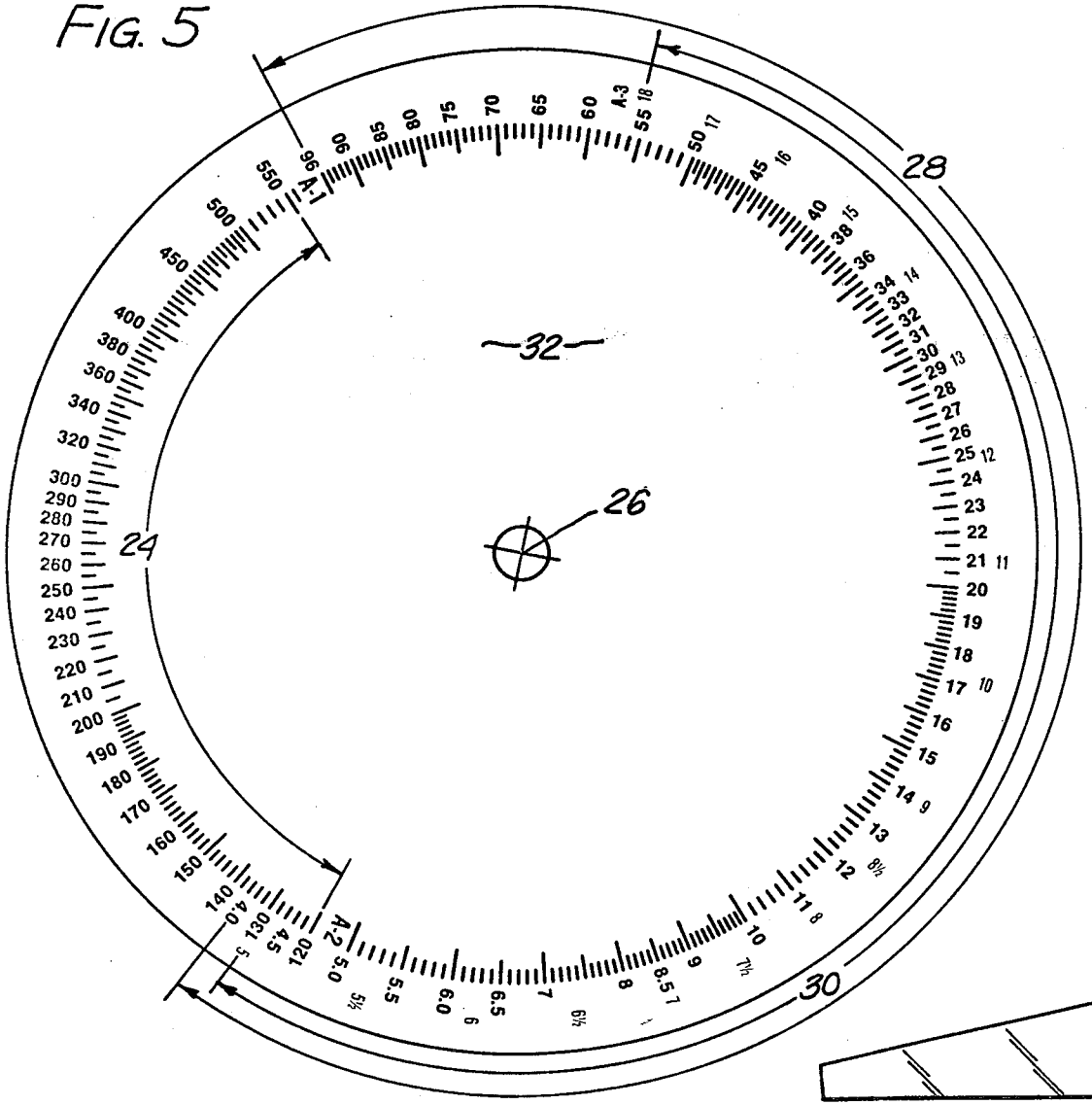
FIG. 5 is a view showing the outer disk of both the computers depicted in FIGS. 1, 3 and 2, 4.
Figure 9:
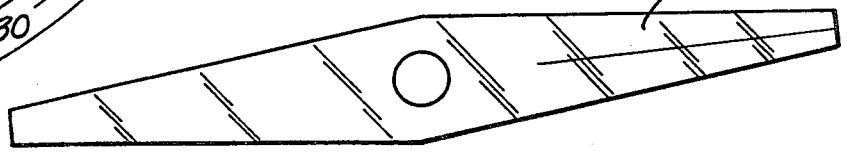
FIGS. 8 and 9 show the two freely rotating cursors of the computer in FIGS. 1 and 3.

The three scales 24, 28 and 30 are also to be found on the largest, or outer disk 32 of the calculator 10 illustrated in FIG. 3, the disk 32 being also shown in FIG. 5.

The calculator 10 of FIG. 1 is made up of three concentric circular disks 34, 36 and 38, which are independently rotatable about a pivot at the center 26, together with two rotatable cursors 40 and 42. Disk 36 has a cursor 44 fixedly attached to it, and disk 38 also has a cursor 46 fixedly attached to it.

Disk 34, shown separately in FIG. 6, has two scales 48 and 50, on its outer edge. Scale 48 represents the line length in picas, from 10 through 45; and 50 represents characters per line, from 5 through 420. Scale 50 on the outer edge goes only from 5 to 100, and then shifts radially inward to continue from 100 to 420 on the next inner ring of numerals. A third scale 52, representing characters per page, manuscript, or book, continues from the 100 mark to 1,000,000, again shifting radially inward at the 10,000 mark to a third ring of numerals, going up to 1,000,000.

Figure 7:
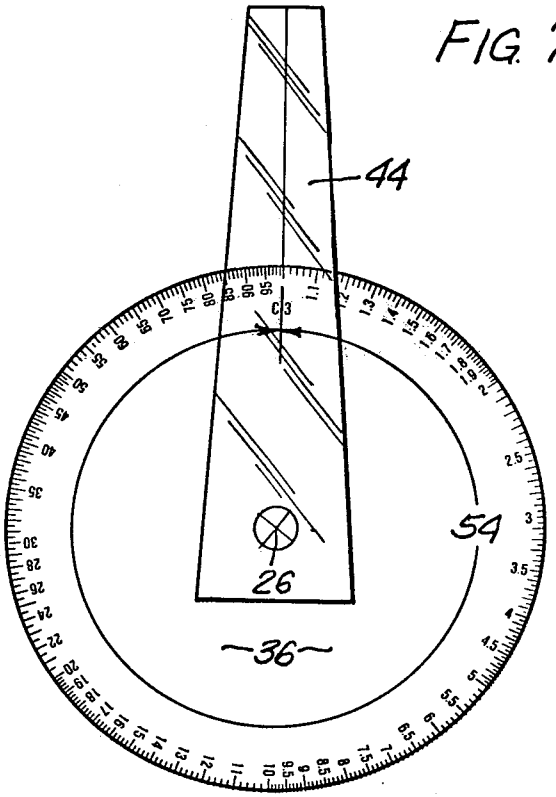
FIG. 7 shows the next smaller disk of the computer in FIGS. 1 and 3.

The next disk is 36, which is shown separately in FIG. 7. Disk 36 has a single scale 54, reading from 1 to 100, which represents the page depth in picas and is also used for number of lines per page and number of pages. Cursor 44 is fixed to the top surface of disk 36, with its index line on top of the numeral "1". All of the 4 cursors 40, 42, 44 and 46 are made of transparent plastic, so that the underlying graduations and numerals can be seen through them. The freely rotatable cursor 42 is located between disks 36 and 34.

Figures 8, 9, 10, 11, 12:
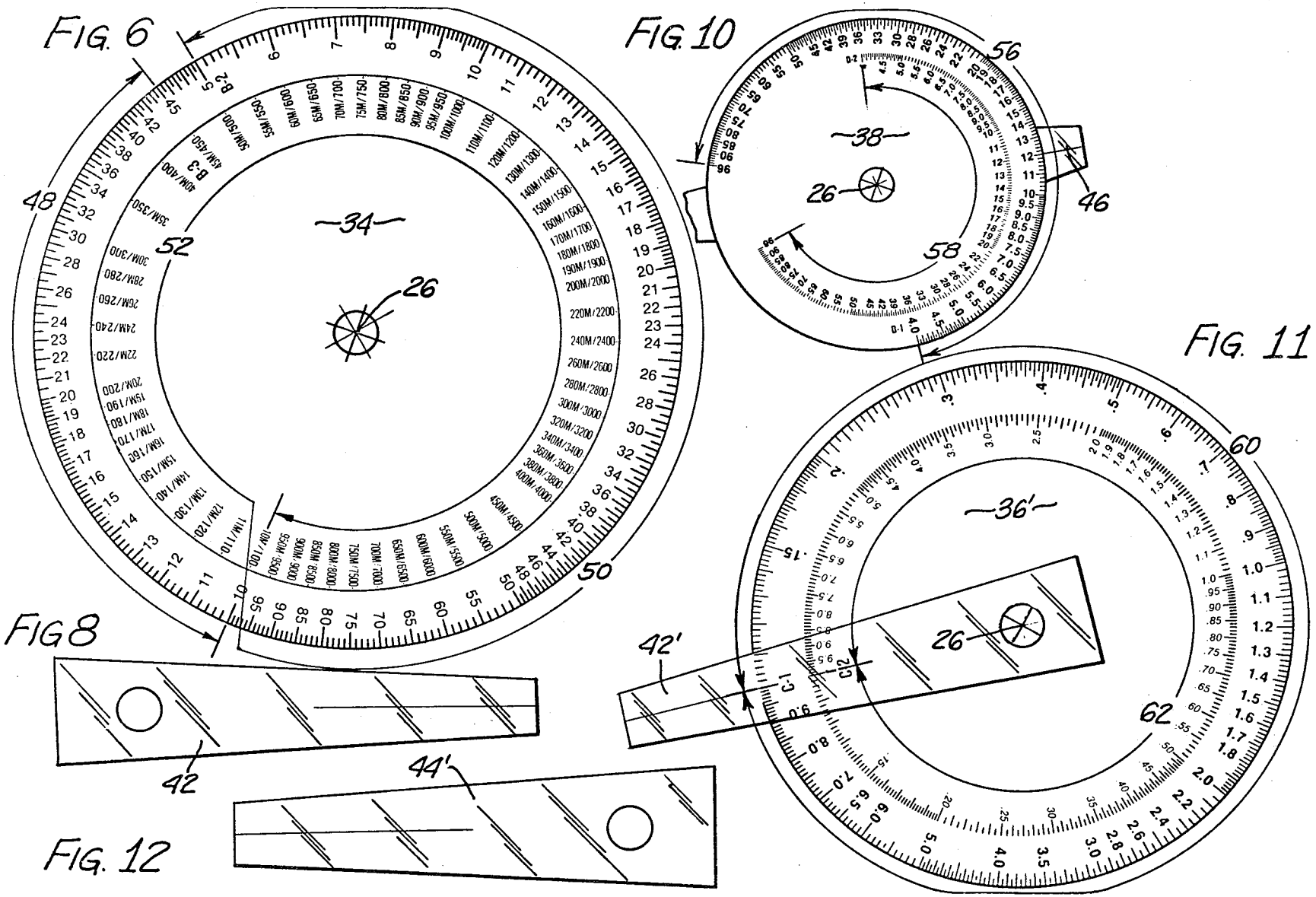
FIG. 10 shows the smallest, or innermost, disk of the computer in FIGS. 1 and 3, with its attached cursor shown fragmentarily.
FIG. 11 shows the next smaller, or innermost, disk of the computer in FIGS. 2 and 4.
FIG. 12 shows the freely rotatable cursor of the computer in FIGS. 2 and 4.

The innermost disk, 38, which is shown separately in FIG. 10, has two circular scales: an outer scale 56, representing line spacing, in points, for single pages, which reads from 4.0 to 96; and an inner scale 58, representing line spacing, in points, for multiple pages. Cursor 46 is fixed to the underside of disk 38, with its index line positioned on the numberal "12". Cursor 40 is located on top of disk 38, and turns freely on its pivot.

The functions of the cursors is as follows: Cursor 42 is used to traverse the Font ID scale 24 on the outer disk 32. At the same time, line length in picas can be read under the index line of cursor 42 from scale 48 on disk 34. Cursor 44 is used to traverse the type size scale 28 on disk 32, and is also used in a special scanning operation, using the point values from 5 through 18 on scale 30 of disk 32. The number of characters per line can be read on scale 50 of disk 34, by reading the numeral under the index line of cursor 44. Cursor 46 is permanently attached to disk 38, and is used to indicate area or page depth, in picas, on scale 54 of disk 36. Cursor 40 serves the all-important function of giving the final results, as it scans all of the scales, and can be turned freely to line up with any given graduation on any one of the scales to give an output reading from any one of the other scales after the disks have been turned appropriately to correspond with the input information. For example, in determining characters per page and lines per page for a given font and line length appearing under cursor 42 on scales 24 and 48, respectively; and a given point size and characters per line appearing under cursor 44 on scales 28 and 50, respectively; and a given page depth value in picas appearing under cursor 46, on scale 54; when cursor 40 is set to a leading value on the outer scale 56 underneath the index line of cursor 40 on scale 54 will be read the lines per page, and on scale 52 will be read the characters per page. When using 12 point line spacing, cursor 40 would be on "12" of scale 56. This being the index of cursor 46, would place cursor 40 directly over cursor 46, and would tell the copy-fitter that page depth and number of lines are equal. For line spacing less than 12, cursor 40 would be set to a smaller value on outer scale 56, resulting in number of lines exceeding the page depth value and a corresponding increase in number of characters per page. For line spacing greater than 12 points, cursor 40 would be set to a value larger than "12" on the outer scale 56, and would result in lines per page being a smaller value than page depth, and a corresponding decrease in characters per page.

The basic operation of the invention is as follows: (1) Place cursor 42 on the desired Font ID value on scale 24. (2) Rotate Disk 34 until the desired line length on scale 48 is under the index line of cursor 42. (3) Move cursor 44, which is attached to disk 36, to the desired number of characters on scale 50 and read point size on scale 28, or move cursor 44 to desired point size on scale 28 and read number of characters on scale 50 (or 52)

Other examples of how the invention may be used are as follows:

EXAMPLE 1

Problem:

Determine the number of characters required to fill 30 pica line in 11 point Times Roman (Font ID 229).

1. Rotate cursor 44 to "229" on scale 24.
2. Rotate disk 34 until "30" on scale 48 appears under the index line of cursor 42.
3. Rotate cursor 44 to "11" on scale 28 and read "67" characters on scale 50 under cursor 44 directly opposite "11". Without changing the position of the cursors, determine the number of characters required to fill a 45 pica line by rotating disk 34 until "45" of scale 48 is under cursor 42, and read "100" under cursor 44. Again, without moving the cursors, determine the line length required for 40 characters, by rotating disk 34 until "40" on scale 50 appears under cursor 44, and read "18" picas on scale 48 under cursor 42.

EXAMPLE 2

Problem:

Determine the Font ID and line length required for 50 characters of 15 point type.

1. Place cursor 44 over "15" on scale 28.
2. Rotate disk 34 until "50" on scale 50 appears under cursor 44.
3. Swing cursor 42 to Font ID "120" on scale 24, and read "16" picas on scale 48 under cursor 42. Font ID 120 being the most condensed, 16 picas is the shortest line possible for 50 characters of 15 point type. By moving cursor 42 up to 45 picas, it can be seen that a Font with an ID of 335 could be used.

EXAMPLE 3

Problem:

Determine the Font ID and point size required to fit 65 characters into a 30 pica line.

1. Place cursor 44 over "65" on scale 50 of disk 34.
2. Place cursor 42 over "30" on scale 48 of disk 34.
3. Rotate disk 32 through the range of Font IDs, and observe that in Font "150", 17 point type could be used, and at Font "525", 5 point type must be selected.

EXAMPLE 4

Problem:

Determine the Font ID for Elite Typewriter.

1. Since Elite is the equivalent to 10 point type, place cursor 44 on "10" of scale 28.
2. We are measuring the alphabet, so rotate disk 34 until "26" on scale 50 appears under cursor 44.
3. Since 26 characters of Elite Typewriter measure 13 picas, swing cursor 42 over "13" on scale 48.
4. Read "280" for the Font ID on scale 24 under cursor 42.

EXAMPLE 5

Problem:

Determine the Font ID for Pica Typewriter

1. Pica Typewriter is equivalent to 12 point type, so place cursor 44 on "12" of scale 28.
2. Rotate disk 34 until "26" appears under cursor 44. The numeral "26" represents the number of characters in the alphabet.
3. The pica alphabet measures 15½ picas, so place cursor 42 over "15½" on scale 48 on disk 34.
4. Read "279" on scale 24. This is the Font ID.

EXAMPLE 6

Problem:

Convert moveable type fonts (Linotype, Intertype, handset, etc.) to the Font ID standard of the present calculator.

1. Move cursor 44 to the point size of the font on scale 28.
2. Rotate disk 34 until "26" appears under cursor 44.
3. Move cursor 42 to the length of the alphabet, in picas, on scale 48 of disk 34.
4. Read Font ID under the index line of cursor 42 on scale 24.

Note: The Font IDs obtained in this example are valid only for the point size calculated.

EXAMPLE 7

Problem:

Determine the number of characters on typewritten copy.

1. Count 26 characters and measure with line gauge. If 13 picas is the measure, it is Elite, which has a Font ID of 280 (see Example 4). Cursor 42 would be set on "280" on scale 24, and cursor 44 to point size "10" on scale 28. If the line gauge measure is 15-½ picas, the Font ID would be 279, and point size of 12.
2. Measure with line gauge the average longest line on the page, and rotate disk 34 until the measure, in picas, appears on scale 48 under cursor 42.
3. The number of characters per line can now be read on scale 50 under cursor 44. Measure depth of copy, in picas, and place cursor 46 to that value on scale 54.
4. Measure line spacing. If the distance from the base of one line to the base of the next is 12 points, move cursor 40 to "12" on scale 56 of disk 38. The number of lines per page will be read from scale 54 under cursor 40, and the number of characters per page will be read from scale 52 under cursor 40. If base line to base line measures 24 points, set cursor 40 to "24" on scale 56 of disk 38, and read number of lines on scale 54 and number of characters per page on scale 52.

EXAMPLE 8

Problem:

With reference to Example 7, determine the number of characters on typewritten copy which is Elite, double-spaced, the longest average line is 38 picas, and page depth is 54 picas.

1. Set cursor 42 to "280" (Font ID) on scale 24, and set cursor 44 to "10" on point size scale 28.
2. Rotate disk 34 until "38" (picas) appears on line length scale 48 under cursor 42, and read "76" characters per line on scale 50 under cursor 44.
3. Set cursor 46 to "54" picas page depth on scale 54.
4. Set cursor 40 to "24" on scale 56, and read "27" lines per page on scale 54, and "2050" characters per page on scale 52.

EXAMPLE 9

Problem:

Extending Example 8, determine the number of characters contained in 30 pages, as outlined above.

1. Starting with the settings obtained in Example 8, consisting of Font ID 280, line length of 38 picas, point size of 10, characters per line of 76, page depth of 54 picas, 27 lines per page, and 2050 characters total, swing cursor 44 around until its index line is directly under the index line of cursor 40.
2. Bring cursors 46 and 40 together and rotate to "30" on scale 54.
3. Read "61,500" under cursor 40 on scale 52 of disk 34.

EXAMPLE 10

Problem:

List the logical sequence of steps to be taken in converting total number of characters in a manuscript to typeset and book form. The seven factors involved in converting a manuscript to book format are: type style, i.e., Font ID; line length; type size; page depth; leading; number of pages; and number of characters. Since these seven factors are potential variables, it is necessary to convert them to constants in order to determine total number of pages, which should be the last factor to be tied down. In the absence of any special instructions or desires, take the middle-of-the-road approach and proceed as follows:

1. Move cursor 42 to "250" Font ID on scale 24.
2. Rotate disk 34 until "22" (for pica line length) is under cursor 42.
3. Swing cursor 44 to "9" point size on scale 28.
4. Set cursor 46 to "36" on scale 54 of disk 36, representing a 36 pica page depth.
5. Set cursor 40 to "9" on scale 56 of disk 38, for 9 point line spacing, and unless the values of "2635"

characters per page (scale 52) and the "48" lines per page that appear on scale 54 are required for some other purpose, it is not necessary to read. Simply proceed to the next step.

6. Traverse cursor 44 until it is directly under cursor 40.
7. Set cursor 40 to "9" on inner scale 58 of disk 38.
8. With cursor 40 being the previously-mentioned passenger of disk 38, manipulate the opposite end of cursor 46 until cursor 40 is over the previously established "61,500" characters (Example 9) on scale 52 of disk 34, and read "23½" pages on scale 54 of disk 36.
9. To determine the additional pages required for a certain amount of line spacing (leading), set cursor 42 directly under cursor 40. This is necessary to mark the previously established total characters of 61,500. By advancing cursor 40 from "9" to "10" on scale 58 of disk 38, it can determine that 26 pages (scale 54) would be required to accommodate the one point line spacing, representing an increase of 2½ pages.
10. To determine the effect of substituting another font for the one selected at (1) above, rotate disks 34 and 38 together as a unit, while maintaining disks 32 and 36 fixed with respect to one another. Adjust the setting until the line length of "22" picas (scale 48) is opposite Font ID of "280". Under cursor 40 it will be found from scale 54 that the number of pages now required is 28½. Since the type is more extended, there are only 49 characters per line (from scale 50) at the 9 point line spacing, and under cursor 44 appears only "2230" characters per page, on scale 52. The page depth remains 36 picas.

The above examples are only a few of the many calculations that can be readily made by merely manipulating the disks 32, 34, 36, 38 and cursors 40, 42, 44, 46 of the calculators shown in FIGS. 1 and 3.

Figure 2:
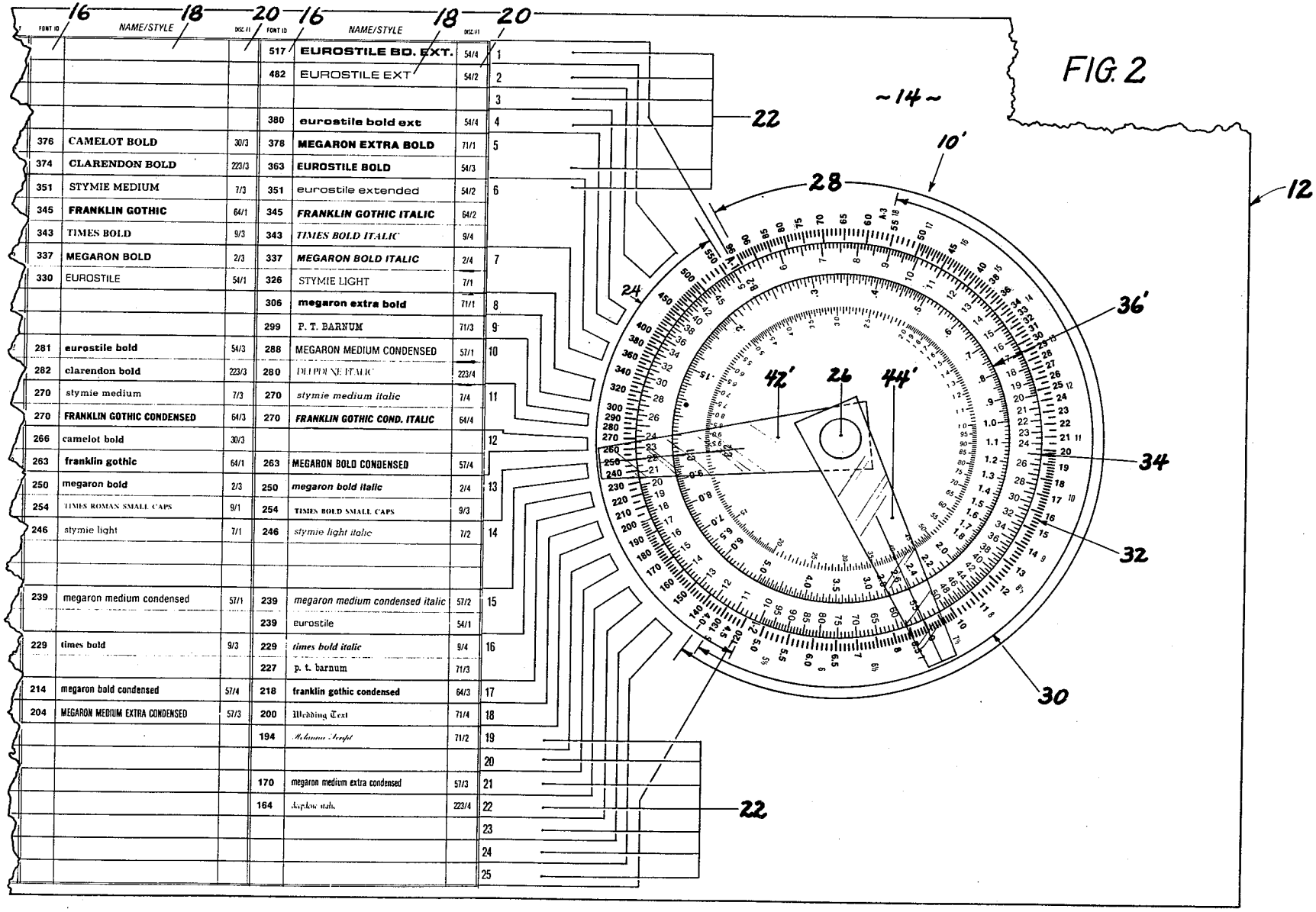
FIG. 2 shows another embodiment of the invention having a circular computer of somewhat less capability than the computer of FIG. 1, which is also integrally associated with a font display chart.
Figure 4:
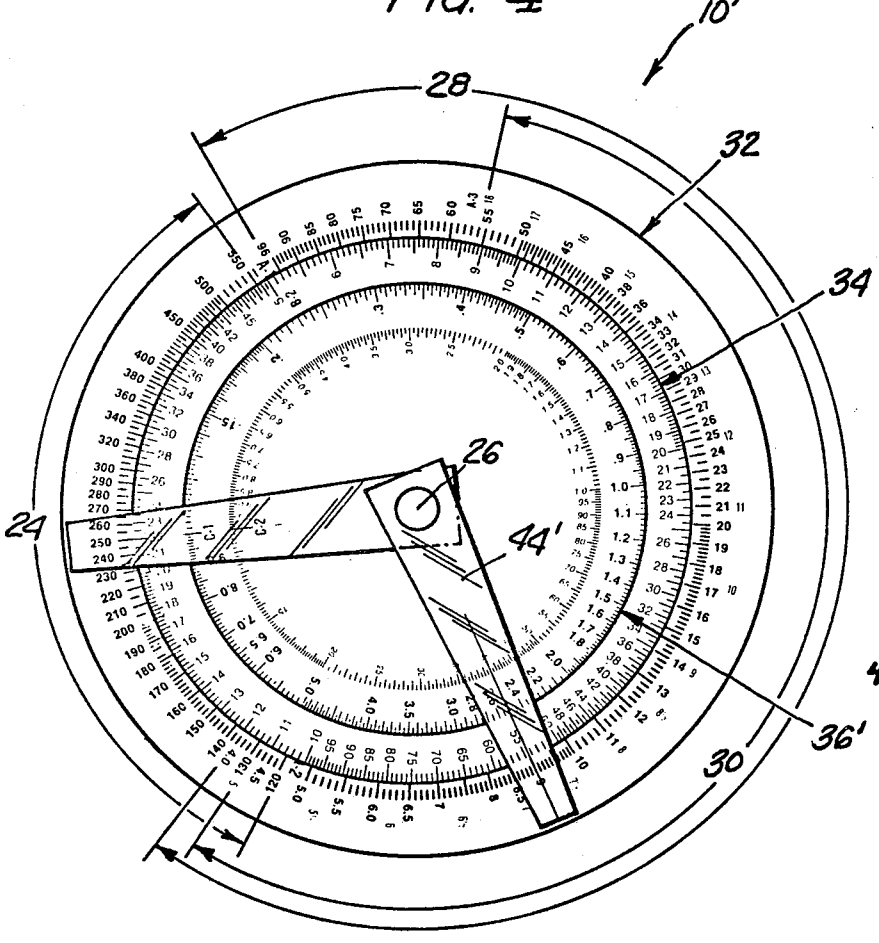
FIG. 4 shows still another embodiment of the invention, comprising the circular computer of FIG. 2, by itself, and without the display chart.

Another, somewhat simpler form of the invention is shown in FIGS. 2 and 4, to which attention is now directed. In this embodiment, the calculator is designated in its entirety by the reference numeral 10'. As in the case of the embodiment in FIGS. 1 and 3, the calculator 10' may be incorporated integrally with a font display chart 12' (FIG. 2) or it may be a separate unit, without the display chart (FIG. 4).

The display chart 12' of FIG. 2 is identical to the display chart 12 of FIG. 1, and need not be described further. The Font ID scale 24 is the same; and scales 28 and 30 of type size are also the same. In the case of the separate calculator of FIG. 4, the large, outer disk 32 is the same as disk 32 of FIG. 2, and scales 24, 28 and 30 are also the same. Disk 34 of FIGS. 2 and 4 is the same as disk 34 of FIGS. 1 and 3, but there is one notable difference, and that is that the two rings of numerals forming scale 52 and the last portion of scale 50 (i.e., from 100 to 420) are covered by disk 36'. Scales 48 and 50 of disk 34 for calculator 10' are the same as the corresponding scales of calculator 10, except that scale 50 ends at "100+ instead of "420".

The innermost disk of calculator 10' is 36', which contains an outer ring 60 of graduations forming a scale of characters per pica, and an inner ring 62 of graduations forming a scale of character width in picas. Fixed to the top surface of disk 36' is a cursor 42', the index line of which is centered on "1" or "10" of both scales 60 and 62. It will be observed, however, that scale 60 increases numerically in clockwise order, while scale 62 increases numerically in counterclockwise order. This is because character width, in picas, is the reciprocal of characters per pica.

Rotatably mounted above disk 36' and its cursor 42' is a freely turning cursor 44', which extends radially outward to the outer periphery of disk 32. While cursor 42' differs from its counterpart 42 of calculator 10 (FIGS. 1 and 3) in the respect that 42' is fixed to a disk (36'), whereas 42 is independent and freely rotatable, the two cursors are used in the same manner when operating their respective calculators. In like manner, cursor 44' differs from its counterpart 44 in the respect that 44' is independent and freely movable, whereas 44 is fixed to disk 36, but here again, the two cursors are used in the same manner when operating their respective calculators.

Calculator 10' is used in the same way as calculator 10 of FIGS. 1 and 3, except that it is used only for copy-fitting individual lines; whereas calculator 10, when provided with page depth, in picas, and line spacing, in points, gives the copy-fitter the number of lines per page, with line spacing in ½ point increments; total number of pages and characters; as well as the change in number of pages when changing fonts, line length, and point size.

Calculator 10' can be used for Examples 1–6, by following the same directions, except that where a cursor or disk is specified by number, that number is understood to include the same number with a prime (') suffix. In addition to Examples 1–6, the following examples of other ways calculator 10' can be used are given:

EXAMPLE 11

Problem:

Determine the Font ID, alphabet length in picas, and average character width for 12 point type with 2.2 characters per pica.

1. Set cursor 44' to "12" on scale 28'.
2. Swing cursor 42' until "2.2" appears under 44' on scale 60.
3. Rotate disk 34' until "26" on scale 50 appears under cursor 44'.
4. Under cursor 44' on scale 62 read "0.455" character width; under cursor 42' on scale 24' read Font ID of "212"; and on scale 48' read alphabet length of "11.8" picas.

EXAMPLE 12

Problem:

Being given the parameters of 0.4 pica character width and a 30 pica line length, determine the number of characters per pica, number of characters per line, and the Font ID and type size combination that would be usable.

1. Set cursor 42 to "30" on scale 48.
2. Set cursor 44' to "0.4" on scale 62.
3. Under 44' on scale 60 read "2.5" characters per pica, and on scale 50' read "75" characters per line.
4. With disks 34' and 36', and cursors 42' and 44' maintained in the above preset condition, rotating disk 32' will present workable Font ID and type size combinations under cursors 42' and 44' respectively. When on scale 24' Font ID "130" (a condensed font) appears under cursor 42', under 44' on scale 28 will appear a type size of "17" points. When Font ID "375" (an extended font) appears under 42' on scale 24', there will appear under 44' on scale 28' a type size of "6" points. It will be noted that in all 13 of the examples given above, two known factors produce the answers to four unknowns. With the present invention, it is possible to find the answers to virtually any problem faced by the copy-fitter, by merely manipulating the disks and cursors as described above.

One final example is given below, which illustrates the use of scale 30 on calculator 10 of FIGS. 1 and 3. In this example, it is assumed that the Font ID is 250; line length is 22 picas; type size is 9 points; page depth is 36 picas; line spacing is 9 points; total number of characters is 61,500; and there are 23½ pages.

EXAMPLE 14

Problem:

Determine the effect a type size change would have on the number of pages if all other factors remained constant.

1. Set cursor 42 to "250" on Font ID scale 24; rotate disk 34 until "22" on line length scale 48 comes under cursor 42; move cursor 44 to "9" on the point size scale 28; move cursor 46 to "36" on page depth scale 54; move cursor 40 to "9" on the single page line spacing scale 56; move cursor 44 to the position directly under cursor 40; move cursor 40 to "9" on the multiple page line spacing scale 58; and manipulate the opposite end of cursor 46 until cursor 40 is over "61,500" on the total characters scale 52 of disk 34.
2. Set cursor 42 under cursor 40. Cursor 42 is now on the "61,500" mark of the total characters scale 52.
3. Advance disk 32 until the "9" on scale 30 is under cursor 44. At this point, any further movement of cursor 44 along scale 30 will produce a corresponding change in the number of pages that appears on scale 54 when cursor 40, for the point size, set solid, that appears under cursor 44 on scale 30. With the cursors and disks set as described, the number of pages appearing under cursor 40 on scale 54 will be "23½".
4. To determine the effect that changing point size has on the number of pages, hold disks 32, 34 and 38 in fixed relationship to one another and swing cursor 44 to another point size on scale 30. For example, if cursor 44 is moved to "6" on scale 30, the number of pages appearing on scale 54 under cursor 40 will be "10½". If cursor 44 is moved to "12" on scale 30, the number of pages appearing on scale 54 will be "42". If it is desired to consider the effects of a change in leading on the number of pages, move cursor 40 from "9" to "10" on scale 58 and it will be observed that the number of pages on scale 54 has increased from "23½" to "26". Thus, increasing line spacing by 1 point has increased the number of pages by 2½ pages.

While I have shown and described in considerable detail what I believe to be the preferred embodiments of the invention, it will be understood by those skilled in the art that the invention is not limited to such details, but may take various other forms within the scope of the claims.

What I claim is:

1. A copyfitting calculator comprising:

a base member (32) having a first graduated scale of Font ID numbers extending along a portion of a circular arc having its center at a pivot axis (26); and a second graduated scale of type size, in points, extending along the remainder of said circular arc, said Font ID numbers being a function of the width, in points, of the alphabet length of various fonts, ranging from the most condensed to the most extended styles in general use;

first, second and third concentric disks (34, 36 and 38) of graduated diameters mounted on said base member and rotatable about said pivot axis, said first disk (34) having a third graduated scale of line length, in picas, extending along a portion of the edge thereof; a fourth graduated scale of characters per line extending along the remainder of said edge; and a fifth graduated scale of characters per page, manuscript or book, said fifth scale being arranged in the form of an inner ring spaced radially inward from said third and fourth scales, said fifth scale forming a numerical continuation of said fourth scale from the 100 mark and extending up to 1,000,000, said first disk being of a diameter such that said first and second scales of said base member are displayed just outside the periphery of the first disk;

said second disk (36) having a sixth graduated scale of page depth in picas, or number of lines per page, ranging from 1 to 100;

said third disk (38) having seventh and eighth graduated scales arranged in the form of two concentric circles, said seventh scale representing line spacing in points for a single page, and said eighth scale representing line spacing in points for multiple pages;

a first cursor (42) independently rotatable about said pivot axis and extending radially outward to overlie said first graduated scale of Font ID numbers and said third graduated scale on said first disk, said first cursor having an index line that crosses both said first and third scales;

a second cursor (40) independently rotatable about said pivot axis and extending radially therefrom to overlie said fifth scale on said first disk, said sixth scale on said second disk, and said seventh and eighth scales on said third disk;

a third cursor (44) fixed to said second disk (36) and rotatable therewith, said third cursor having its index line set on the numeral "1" of said sixth scale and extending radially outward to overlie said scales on said base member (22) and on said first disk (34); and a fourth cursor (46) fixed to said third disk (38) with its index line positioned on the numeral "12" of said seventh scale, said fourth cursor projecting radially to overlie said sixth scale on said second disk.

2. A copyfitting calculator as in claim 1, wherein said base member is an integral part of a font display chart having a list of different fonts available for use, said list of fonts being arranged in a column with Font ID numbers descending in numerical order from one end to the other; and guide paths leading from each font to the corresponding Font ID number on said first scale, whereby the copyfitter is able to see the various fonts that are available for each Font ID number.

* * * * *